US005960685A

United States Patent [19]

Shyong-Chuan et al.

[11] Patent Number: 5,960,685

[45] Date of Patent: Oct. 5, 1999

[54] TORQUE WRENCH

[76] Inventors: Chen Shyong-Chuan, 89-1, 121 Alley, Tu Chen Rd. Ta Li Hsiang, Taichung Hsien, Taiwan; Guo Yng-Horng, No. 20, Da Chen St. Ta Li Hsiang, Taichung Hsien, Taiwan

[21] Appl. No.: 09/132,243

[22] Filed: Aug. 11, 1998

[51] Int. Cl.[6] ..... B25B 19/00

[52] U.S. Cl. ..... 81/463; 81/466

[58] Field of Search ..... 81/463, 465, 466, 81/478, 480, 481, 483, 475

*Primary Examiner*—D. S. Meislin
*Attorney, Agent, or Firm*—Rosenberg, Klein & Bilker

[57] ABSTRACT

A torque wrench includes a tubular body having a head portion pivotally connected thereto and a cap movably connected thereto opposite to the head portion. The head portion has a concave end from which a tongue extends. Two first springs respectively extend in opposite from an inner periphery of the body and contact a neck of the head portion. A mediated member is movably received in the body and has a stub and a rod respectively extending from two ends thereof. A second spring is mounted to the rod and urged between the cap and the mediated member, the stub having a sphere end movably received in the concave end of the neck, a shoulder portion defined on the mediated member and surrounding the stub. The tongue is movable between a first position where the tongue contacts an outer periphery of the mediated member, and a second position where the tongue contacts against the shoulder portion.

4 Claims, 5 Drawing Sheets

TORQUE WRENCH

FIELD OF THE INVENTION

The present invention relates to a wrench, and more particularly, to a torque wrench whose head portion exerting a large and sudden torque to loose a tightly secured bolt or the like.

BACKGROUND OF THE INVENTION

When loosening a tightly secured nut or bolt, a large torque is necessary to apply to the nut or bolt and this is generally achieved by using a tool such as a wrench. The nut or bolt to be loosened could get rust so that it is difficult to be loosened, the user often uses another tool to strike the body of the wrench so as to produce a sudden and large torque to shake and loosen the nut or bolt. This action can only proceeded when there has an space large enough to allow the swing of the tool. Generally, the wrench itself cannot provide the necessary sudden and large torque.

The present invention intends to provide a torque wrench wherein the head portion of the wrench is engaged with a means in the body of the wrench so that when rotating the wrench, the head portion is first rotated about a pivot to provide a large and sudden torque to loosen the nut or bolt. The torque wrench of the present invention effectively mitigates and obviates the disadvantages mentioned above.

SUMMARY OF THE INVENTION

In accordance with one aspect of the present invention, there is provided a torque wrench comprising a tubular body having a first end thereof with a head portion pivotally connected thereto and a second end having a cap movably connected thereto. The head portion has a neck inserted in the body and the neck has a concave end from which a tongue extends. Two first springs respectively diametrically in opposite extend from an inner periphery of the body and contact the neck.

A mediated member is movably received in the body and has a first end from which a stub extends and a second end from which a rod extends. A second spring is mounted to the rod and urged between the cap and the mediated member. The stub has a sphere end movably received in the concave end of the neck. A shoulder portion is defined on the mediated member and surrounds the stub. The tongue is movable between a first position where the tongue contacts an outer periphery of the mediated member, and a second position where the tongue contacts against the shoulder portion.

It is an object of the present invention to provide the torque wrench whose head portion is pivoted about the pivot on the body so as to apply a sudden and large torque to the object to be loosened.

Further objects, advantages, and features of the present invention will become apparent from the following detailed description with appropriate reference to the accompanying drawings.

DETAILED DESCRIPTION OF THE PREFERRED EMBODIMENTS

Figure 1:
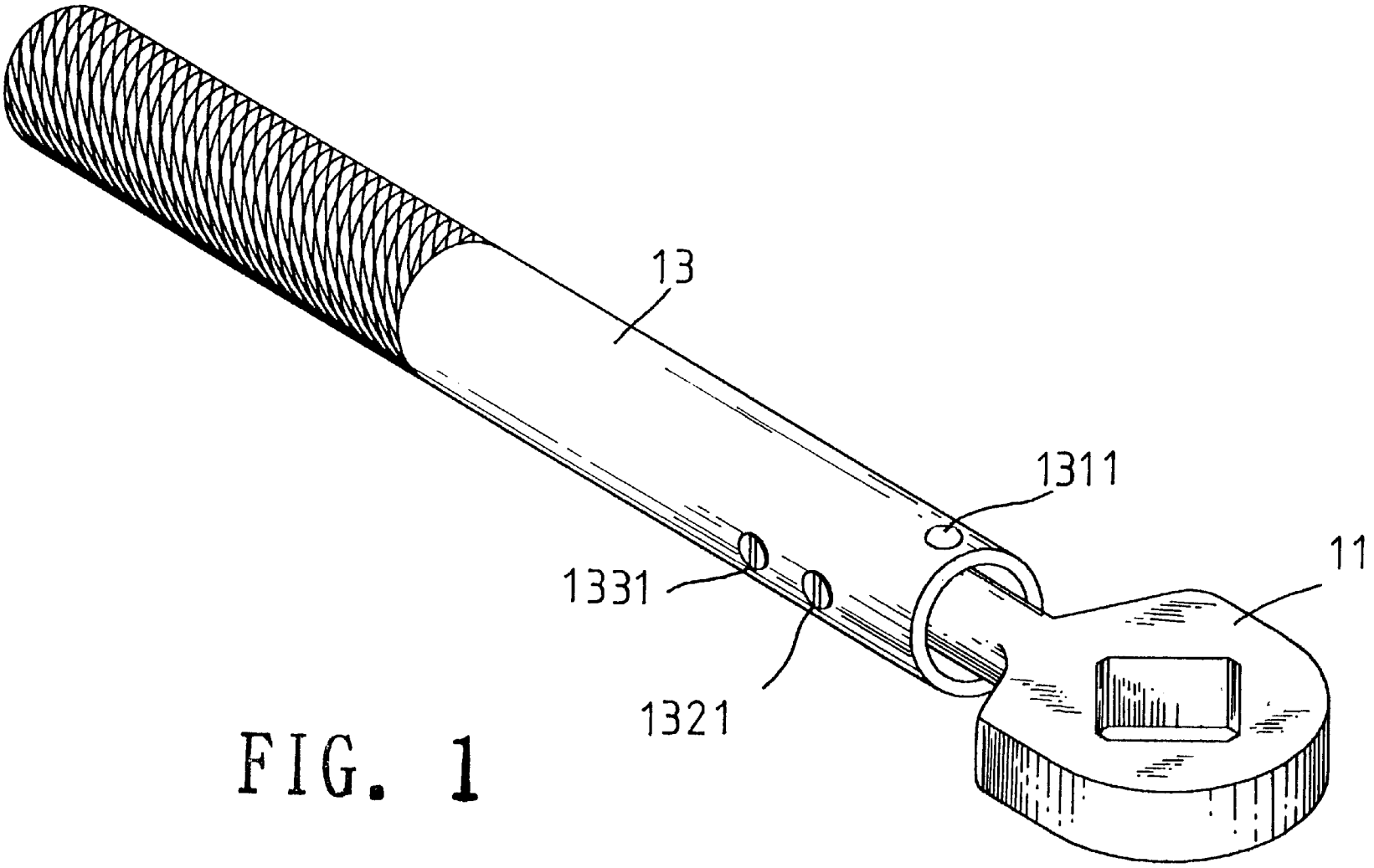
FIG. 1 is a perspective view of a torque wrench in accordance with the present invention.
Figure 2:
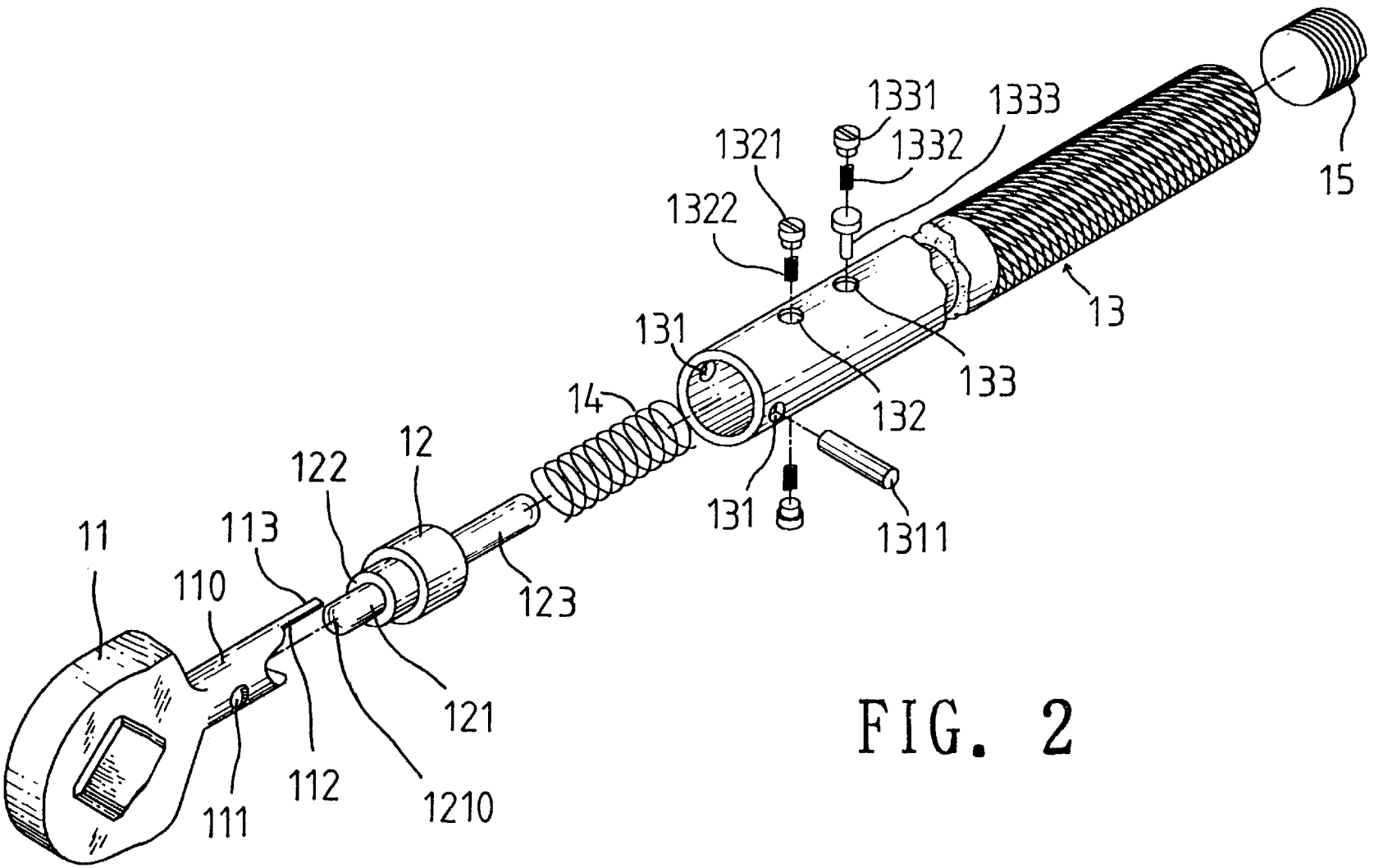
FIG. 2 is an exploded view of the torque wrench in accordance with the present invention.

Referring to FIGS. 1 through 4, a torque wrench comprises a tubular body 13 having a first end thereof with a head portion 11 pivotally connected thereto and a second end having a cap 15 threadedly and movably connected thereto. The head portion 11 has a neck 110 inserted in the body 13 and the neck 110 has a concave end 112 from which a tongue 113 extends. The body 13 has two first holes 131 defined through a peripheral wall of the first end thereof and the neck 110 has a second hole 111 defined therethrough, a pivot 1311 extending through the first holes 131 and the second hole 111. Two first springs 1322 are respectively and diametrically received in two respective apertures 132 defined through the peripheral wall of the body 13 and contact the neck 110, each of the apertures 132 has a bolt 1321 received therein to close the aperture 132. The body 13 further has another aperture 133 defined through the peripheral wall thereof so as to receive a spring 1332 and a pin 1333 therein, the aperture 133 is closed by a bolt 1331. The pin 1333 movably extends inwardly and radially from the inner periphery of the body 13 and has a first inclined surface 1334 defined in a distal end thereof.

A mediated member 12 is movably received in the body 13 and has a first end from which a stub 121 extends and a second end from which a rod 123 extends. A second spring 14 is mounted to the rod 123 and urged between the cap 15 and the mediated member 12 so that the mediated member 12 is movable in the longitudinal direction. The stub 121 has a sphere end 1210 movably received in the concave end 112 of the neck 110 and a shoulder portion 122 is defined on the mediated member 12 and surrounds the stub 121. The tongue 113 is movable between a first position where the tongue 113 contacts an outer periphery of the mediated member 12, and a second position where the tongue 113 contacts against the shoulder portion 122. The tongue 113 has a second inclined surface 1130 defined in a distal end thereof so that the first inclined surface 1334 is engaged with the second inclined surface 1130 when the tongue 113 is located in the first position.

Figure 6:
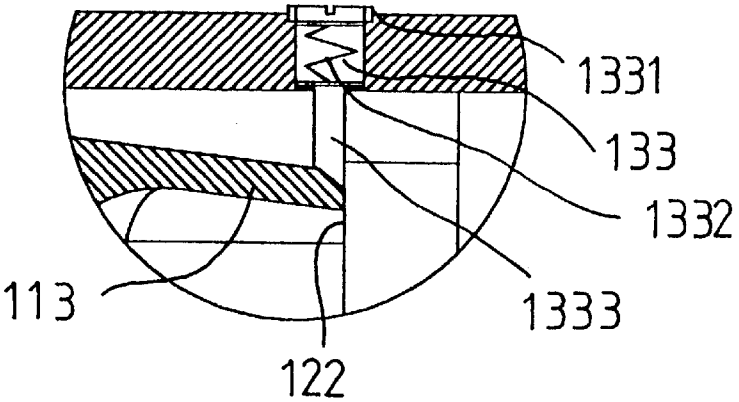
FIG. 6 is an illustrative view to show the positions of the tongue of the head portion and the pin when the torque wrench is in the status shown in FIG. 5.
Figure 5:
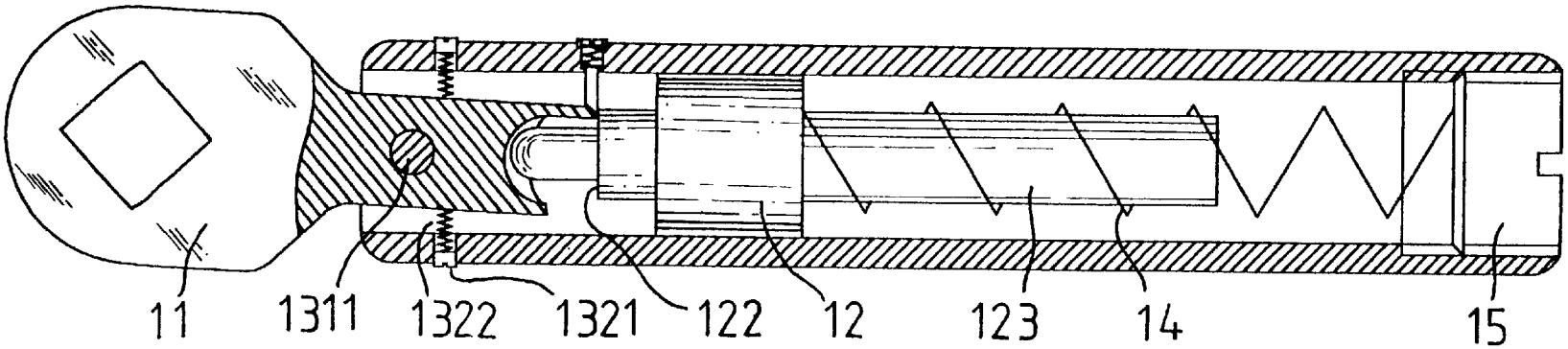
FIG. 5 is a side elevational view, partly in section, of the torque wrench when the mediated member is moved the head portion is pivoted.

Referring to FIGS. 5 and 6, when operating the torque wrench of the present invention to loosen a tightly secured bolt or nut by rotating the second end of the body 13, the sphere end 1210 of the stub 121 is moved along the concave end 112 of the neck 110 so that the mediated member 12 is pushed toward the second end of the body 13 and the shoulder portion 122 is moved with the mediated member 12 so that the distal end of the tongue 113 contacts against the shoulder portion 122.

Figure 3:
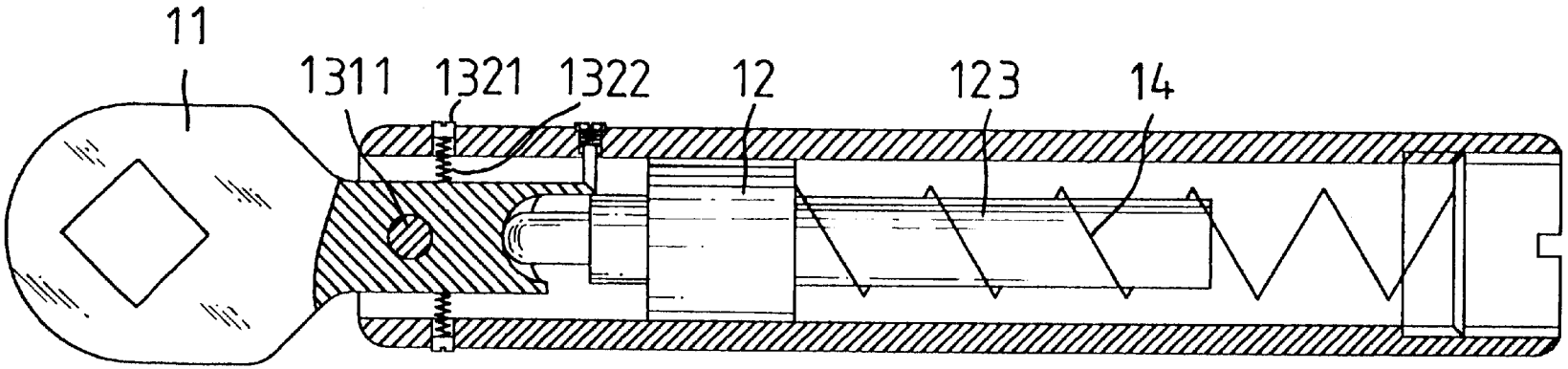
FIG. 3 is a side elevational view, partly in section, of the torque wrench when not being operated.
Figure 4:
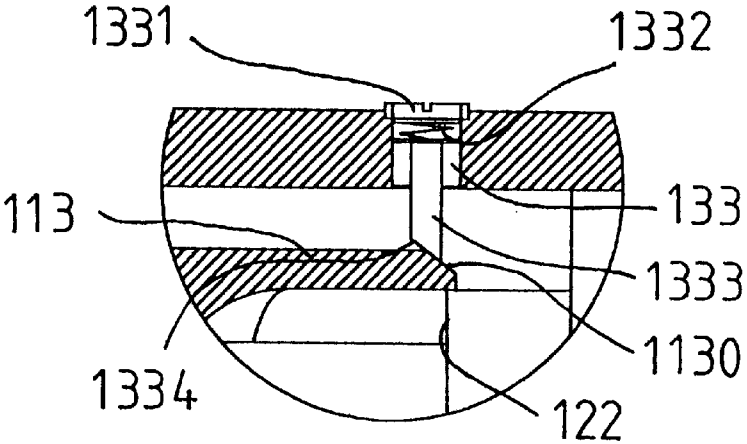
FIG. 4 is an illustrative view to show the positions of the tongue of the head portion and the pin when the torque wrench is in the status shown in FIG. 3.
Figure 7:
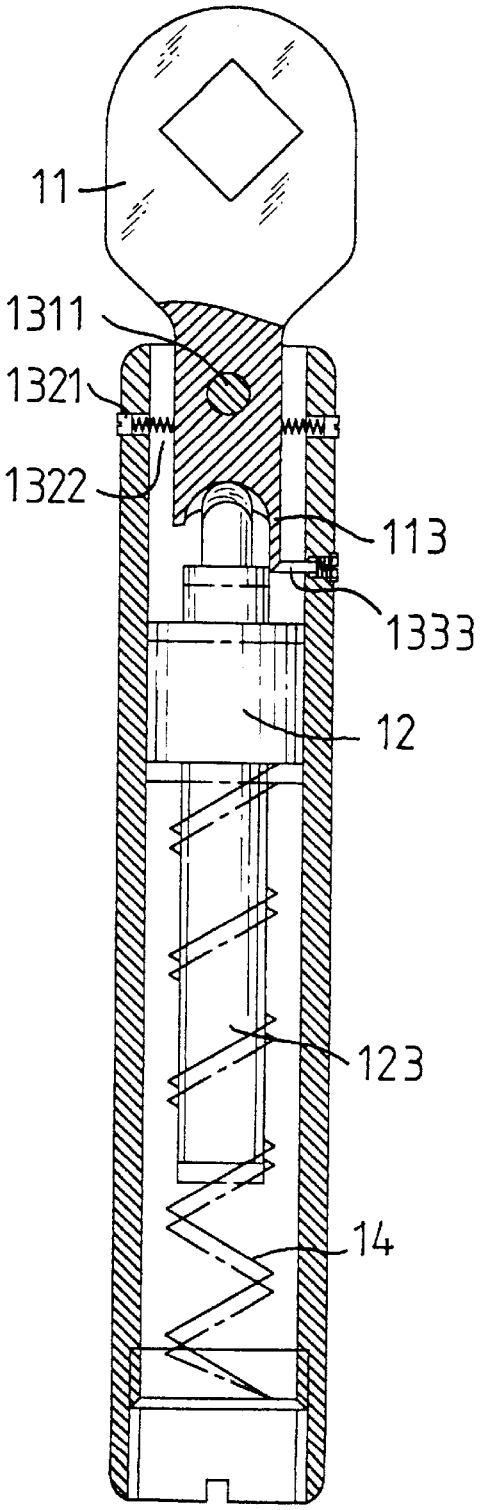
FIG. 7 is a side elevational view, partly in section, of the torque wrench when the head portion is pivoted form the position shown in FIG. 5 back to its original position.

Referring to FIG. 7, when the tongue 113 is positioned in the position as shown in FIGS. 5 and 6, the sphere end 1210 of the stub 121 tends to move back to the stable position as shown in FIG. 3 because the concave end 113 has a curved inner periphery which makes the position of the sphere end 1210 as shown in FIGS. 5 and 6 is unstable. In addition, the two first springs 1322 respectively push and pull the neck 110 to its original position as shown in FIGS. 3 and 4, so that the head portion 11 will rotate suddenly and powerfully by the forces of the first springs 1322 and the second spring 14, and the tongue 113 slips over the shoulder portion 122. The powerful rotational action of the head portion 11 applies a large torque to the bolt or nut to loosen it. Such action can be proceeded repeatedly to achieve the purpose of loosening the bolt or nut.

Figure 8:
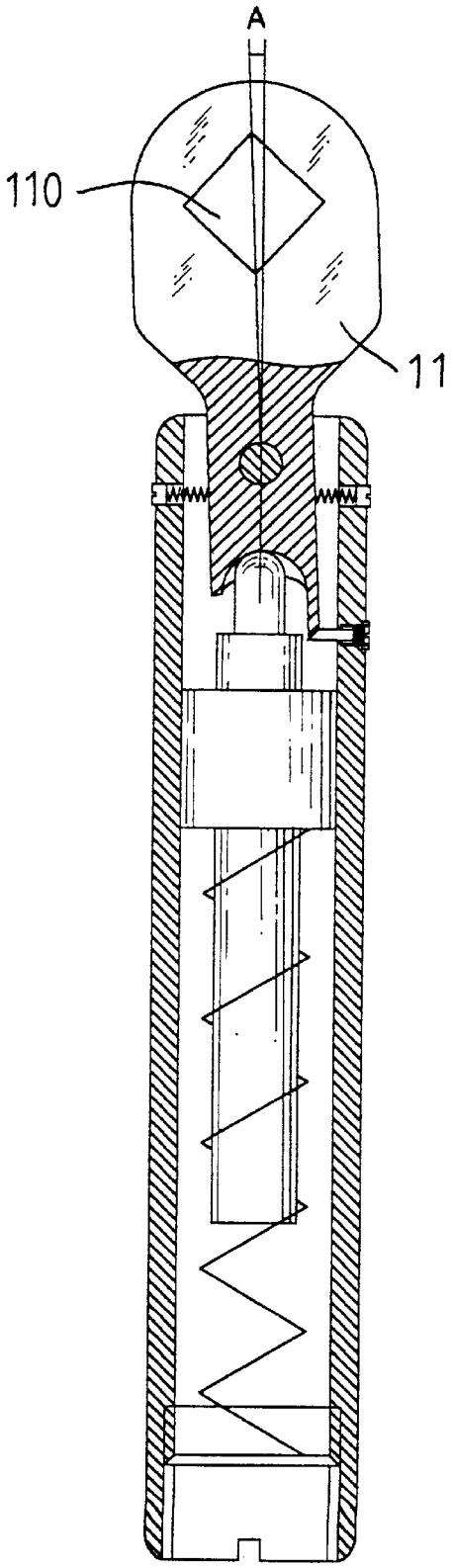
FIG. 8 is another embodiment of the torque wrench of the present invention.

Referring to FIG. 8, in order to have a large angle of rotation of the head portion 11, the driving shaft 110 of the head portion 11 can be positioned to have an angle "A" relative to the longitudinal axis of body 13. Therefore, when operating the torque wrench as described above, the rotational angle of the head portion 11 is more larger and the torque applied is also larger.

Although the invention has been explained in relation to its preferred embodiment, it is to be understood that many other possible modifications and variations can be made without departing from the spirit and scope of the invention as hereinafter claimed.

The invention is not limited to the above embodiment but various modification thereof may be made. It will be understood by those skilled in the art that various changes in form and detail may made without departing from the scope and spirit of the present invention.

What is claimed is:

1. A torque wrench comprising:

a tubular body having a first end thereof with a head portion pivotally connected thereto and a second end having a cap movably connected thereto, said head portion having a neck inserted in said body and said neck having a concave end from which a tongue extends, two first springs respectively extending from an inner periphery of said body and contacting said neck, and a mediated member movably received in said body and having a first end from which a stub extends and a second end from which a rod extends, a second spring mounted to said rod and urged between said cap and said mediated member, said stub having a sphere end movably received in said concave end of said neck, a shoulder portion defined on said mediated member and surrounding said stub, said tongue movable between a first position where said tongue contacts an outer periphery of said mediated member, and a second position where said tongue contacts against said shoulder portion.

2. The torque wrench as claimed in claim 1, wherein said cap is threadedly received in said body.

3. The torque wrench as claimed in claim 1 further comprising a pin movably extending inwardly and radially from said inner periphery of said body, said pin having a first inclined surface defined in a distal end thereof and said tongue having a second inclined surface defined in a distal end thereof, said first inclined surface engaged with said second inclined surface when said tongue is located in said first position.

4. The torque wrench as claimed in claim 1, wherein said body has two first holes defined through a peripheral wall of said first end thereof and said neck has a second hole defined therethrough, a pivot extending through said first holes and said second hole.

* * * * *